US005694140A

United States Patent [19]

Waterman et al.

[11] Patent Number: 5,694,140

[45] Date of Patent: Dec. 2, 1997

[54] NON-SQUINTING MAST ANTENNA AND CLOSED LOOP CONTROL THEREOF

[75] Inventors: Timothy G. Waterman, Eldersburg; Gary E. Evans, Hanover, both of Md.

[73] Assignee: Westinghouse Electric Corporation, Pittsburgh, Pa.

[21] Appl. No.: 565,566

[22] Filed: Nov. 30, 1995

[51] Int. Cl.[6] ..... H01Q 11/08

[52] U.S. Cl. ..... 343/895; 343/723

[58] Field of Search ..... 343/895, 723, 343/750; 342/378; H01Q 1/36, 11/08

[56] References Cited

U.S. PATENT DOCUMENTS 3,419,875 12/1968 Aasted ..... 343/895

3,629,937 12/1971 Fredriksson et al. ..... 343/895

3,702,481 11/1972 Koller et al. ..... 343/895

5,485,170 1/1996 McCarrick ..... 343/895

*Primary Examiner*—Michael C. Wimer

[57] ABSTRACT

A non-squinting helical antenna is divided into segments separated by a coupler. This coupler is preferably a four port coupler which serves as a summation and difference power divider. Such a four port coupler allows the formation of a closed loop for controlling the steering angle of the antenna. The summation and difference signals between segments are monitored, and the ratio of these signals is used to determine and correct error in steering. The steering angle of the antenna can thus be maintained over a range of frequencies within a decibel of error.

10 Claims, 4 Drawing Sheets

NON-SQUINTING MAST ANTENNA AND CLOSED LOOP CONTROL THEREOF

CROSS-REFERENCE TO RELATED APPLICATIONS

The present application is related to U.S. Pat. No. 5,489,916 filed on Aug. 26, 1994, the disclosure of which is hereby incorporated by reference.

BACKGROUND OF THE INVENTION

1. Field of the Invention

The present invention relates to mast antennas and, more particularly, to an end-fed non-squinting segmented mast antenna having a closed loop control.

2. Description of the Related Art

In general, helical antennas are wound around a central mast and are suitable for radiating in an omni-directional azimuth cone with one elevation beam peak between 0° and 90°. Such antennas can have one or more helical conductors. Each conductor has a feed end and a far end, the end being designated as the feed end accepts antenna input. The far end may be left as an open circuit, or in the case of multiple conductors, the far ends may be short-circuited together.

An example of a conventional mast antenna is shown in FIG. 1A. A mast antenna 10 includes a conductor 11, a feed end 12 and a far end 14. The antenna 10 is shown only having a single conductor for simplicity.

The elevation angle of radiation of the helical antenna is determined by the phase-length around one full turn and the spacing of the turns. Since almost a wavelength is usually skipped in each turn, the beam usually steers somewhat back towards the source. The skipped wavelength makes the beam steering angle frequency sensitive, as shown in FIG. 1B.

Thus, the pointing angle of the radiation pattern of an end-fed antenna changes with frequency, i.e., squints, where the higher and lower frequency radiating away from the feed end at an angle $\Delta\theta$(in radiance) from the midband frequency $F_O$, where $\Delta\theta$ equals $\Delta F$ over $F_O$ where $\Delta F$ equals the difference in Hz between the midband frequency and the higher or lower frequency. This can be seen in FIG. 1B where the radiation pattern 18 is for the midband frequency $F_O$, the radiation pattern 16 is for a frequency lower than that of the midband frequency, $F_L = F - \Delta F$, and the radiation pattern 20 is for the frequency higher than the midband frequency, $F_H = F + \Delta F$.

This squint with frequency is undesirable as it tends to result in beams pointing in different directions, e.g., one direction when transmitting and another direction when receiving. The steering angle can be adjusted by twisting a helix to have more or less phase in one turn. This twisting may be performed either manually or it may be mechanized in a known manner. This adjustable twist must currently be made in an open loop based on prior knowledge of the geometry of the system.

The beam's squint with frequency is a severe problem with antennas having tunable frequencies or with antennas for which the transmit and receive frequencies differ. For example, a proposed satellite communications network is designed to operate in the L-band of RF frequencies, and a particular configuration thereof includes sending signals to the satellite of frequencies between 1626 MHz and 1660 MHZ, and receiving signals from the satellite of frequencies between 1525 MHz and 1559 MHz. The satellite is proposed to be 22,600 miles above the equator. Energy travelling this great distance will undergo a large amount of attenuation, and thus maintaining the response of the satellite over all frequencies of interest is of the utmost importance.

SUMMARY OF THE INVENTION

It is therefore an object of the present invention to provide a non-squinting antenna. It is a further object of the present invention to provide closed loop correction for squint present in an antenna. It is a further object of this invention to provide such compensation while still using twisting for steering both within and between segments of the antenna. It is another object of the present invention to provide the above advantages while generating a monopulse beam.

These and other objects are achieved by providing a helical antenna including a central mast having at least one conductive helix disposed about the mast. Each of the conductive helices is divided into a plurality of segments. A plurality of couplers separate adjacent segments of the plurality of segments. Preferably each of the couplers is a four port coupler. The helical antenna may further include a phase shifter in one of the adjacent segments. Adjacent segments of the plurality of segments have a different number of turns.

The four port coupler preferably receives a signal from a first segment and a signal from a second segment, and outputs a summation and a difference signal of separated segments.

The four port coupler feeds a closed loop with the summation signal and the difference signal. The closed loop outputs a control signal to the twist mechanism. The closed loop includes a detector which detects the summation signal and the difference signal, a ratio unit which calculates a ratio of summation signal to the difference signal, and a twist control unit which determines an amount of twisting required by the twisting mechanism in accordance with the ratio.

The helical antenna may further include a twist mechanism which alters the spacing and number of turns in each of the plurality of segments, thereby adjusting a steering angle of the helical antenna. Advantageously, the twist mechanism twists each of the plurality of segments by an equivalent amount.

These and other objects of the present invention may further be accomplished by providing a method of reducing squint in a helical antenna. Such a method includes the steps of providing at least one conductive helix disposed about a central mast, providing each conductive helix with means for receiving a signal to be transmitted and delivering a received signal, dividing each of the conductive helices into a plurality of segments, and separating adjacent segments of the plurality of segments with a coupler, preferably having four ports. The method may further include shifting a phase in one segment of adjacent segments of the plurality of segments.

The method may further include switching between delivering a transmission signal to the segments and delivering a summation signal and a difference signal of signals received by the separated segments to a closed loop. The output of the closed loop may be found by detecting the summation signal and the difference signal, taking the ratio of the summation signal and the difference signal, and determining the output of the closed loop in accordance with the ratio.

The method further includes altering a number of turns in the plurality of segments in accordance with an output of the closed loop. The altering step may include twisting each of the plurality of segments by an equivalent amount.

These and other objects of the present invention will become more readily apparent from the detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limited to the present invention and wherein.

DETAILED DESCRIPTION OF THE PREFERRED EMBODIMENTS

Figure 1A:
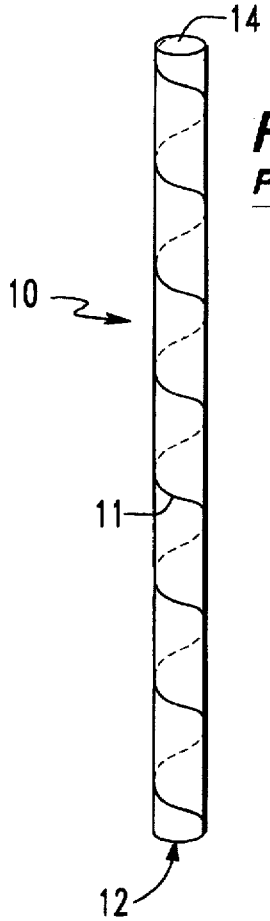
FIG. 1A PRIOR ART
FIG. 1A is a conventional helix antenna.
Figure 1B:
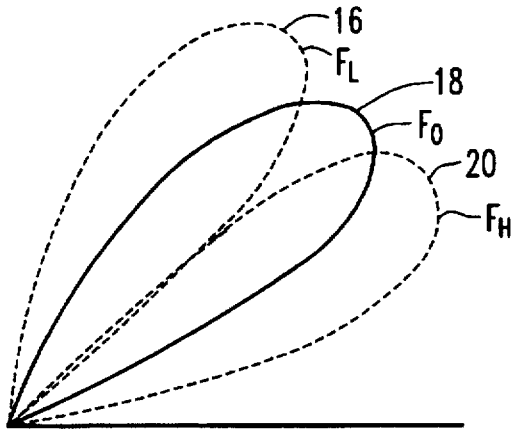
FIG. 1B PRIOR ART
FIG. 1B shows the radiation patterns of different frequencies for the antenna in FIG. 1A.
Figure 2B:
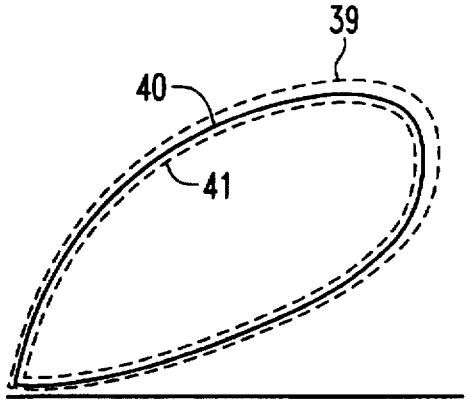
FIG. 2B shows a radiation pattern and various frequencies for the antenna shown in FIG. 2A.
Figure 2A:
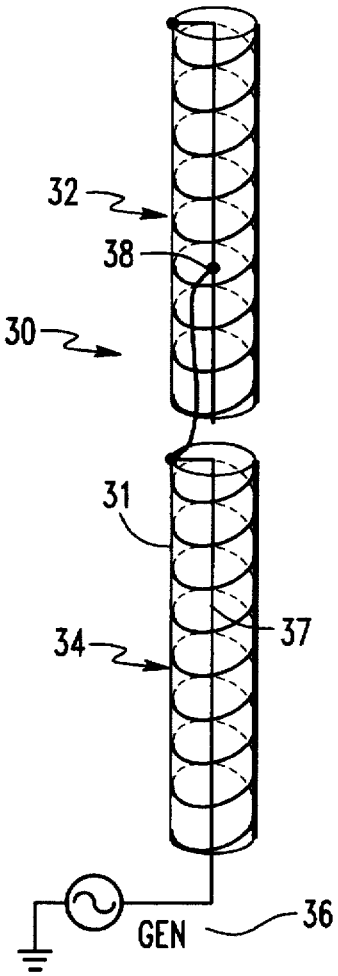
FIG. 2A shows a segmented helix antenna of the present invention.

Referring to FIG. 2A, if an M turn helix 30 wound around a central mast 31 is segmented into N parts 32 and 34 each having M/N turns, and these segments are fed from generator 36 with their midband phase, the helix 30 will continue to radiate at the midband squint angle, as can be seen in FIG. 2B. A central feed tube 37 serves as the feed line to the segments 32, 34. Only a single conductor divided into only two segments has been shown for simplicity. The diameter of the mast can be made larger in order to increase the amount of energy radiated per inch.

A simple tee coupler 38 serves as a divider between the segments 32 and 34. If the coupler 38 feeding the segments skips no wavelengths, the array factor will have little squint. Since the array factor is narrower than the segment pattern factor, the array factor will predominate in locating the overall pattern peak. The array dominates and is fixed in space, as shown in FIG. 2B, where radiation pattern 40 for the midband frequency $F_0$ is in the same position as the radiation pattern 39 for the lower frequency $F_L$ and radiation pattern 41 for the higher frequency $F_H$. Squinting will be slight.

If the helix 30 is twisted, the phase of the segments 32 and 34 changes by the twist angle per turn times the turns per segment. Thus, the array factor being peaked steers to the same angle as the segment peaks. Hence, twisting can still be used for steering such segments.

Figure 2C:
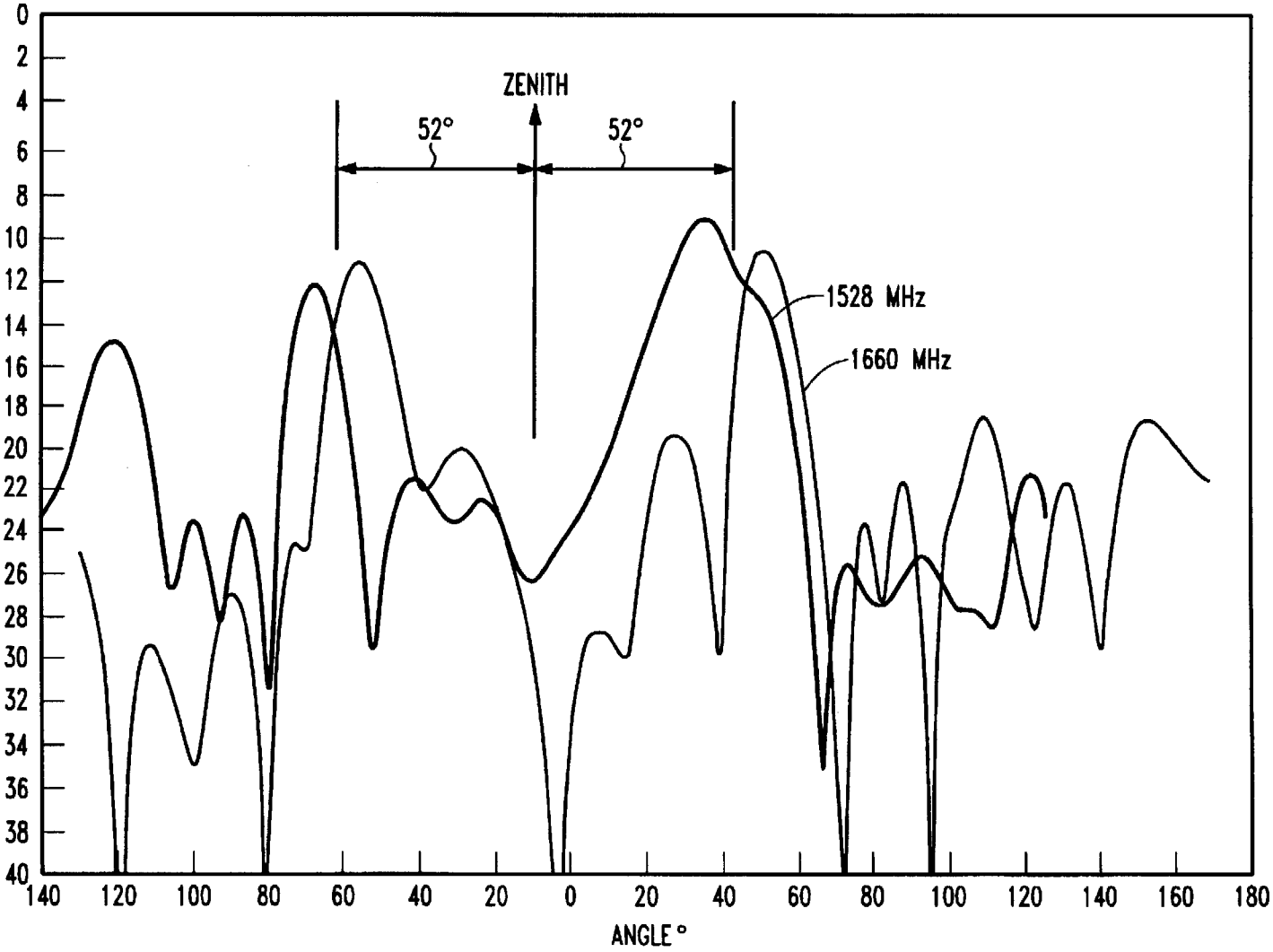
FIG. 2C PRIOR ART
FIG. 2C is a radiation pattern from a conventional antenna at different frequencies.

In FIG. 2C, an elevation pattern is shown for a conventional 30 inch, bifilar helical antenna having 4.25 inches per turn, tested at 1520 MHz and 1660 MHz for which there is 38° steering from the beam center to the horizon. The beam squints enough that if the antenna is aimed to receive at 1520 MHz, the transmit signal of 1660 MHz would be 10 dB off the peak.

Figure 2D:
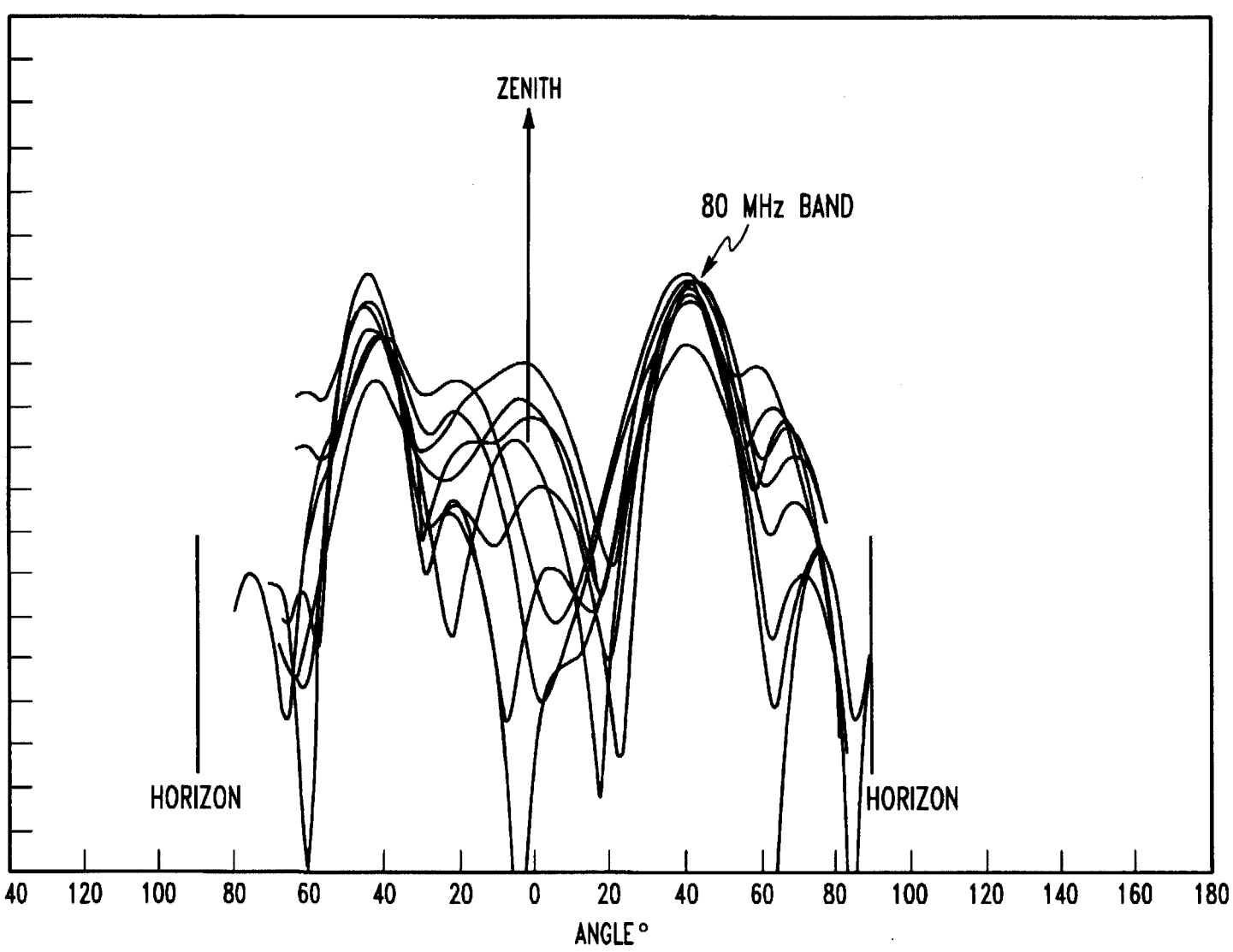
FIG. 2D is a radiation pattern from a segmented antenna as shown in FIG. 2A of the present invention over a frequency range.

In FIG. 2D, the elevation pattern is shown for a helix of two 15 inch, bifilar segments halves for which there is 47° steering from the beam center to the horizon, which gives nearly constant steering angle over an 80 MHz frequency range, i.e., from 1470 MHz–1550 MHz. The antenna of the present invention is particularly intended to be used for steering over the range of 25° to 70° in elevation at 1525 MHz to 1660 MHz.

Figure 3A:
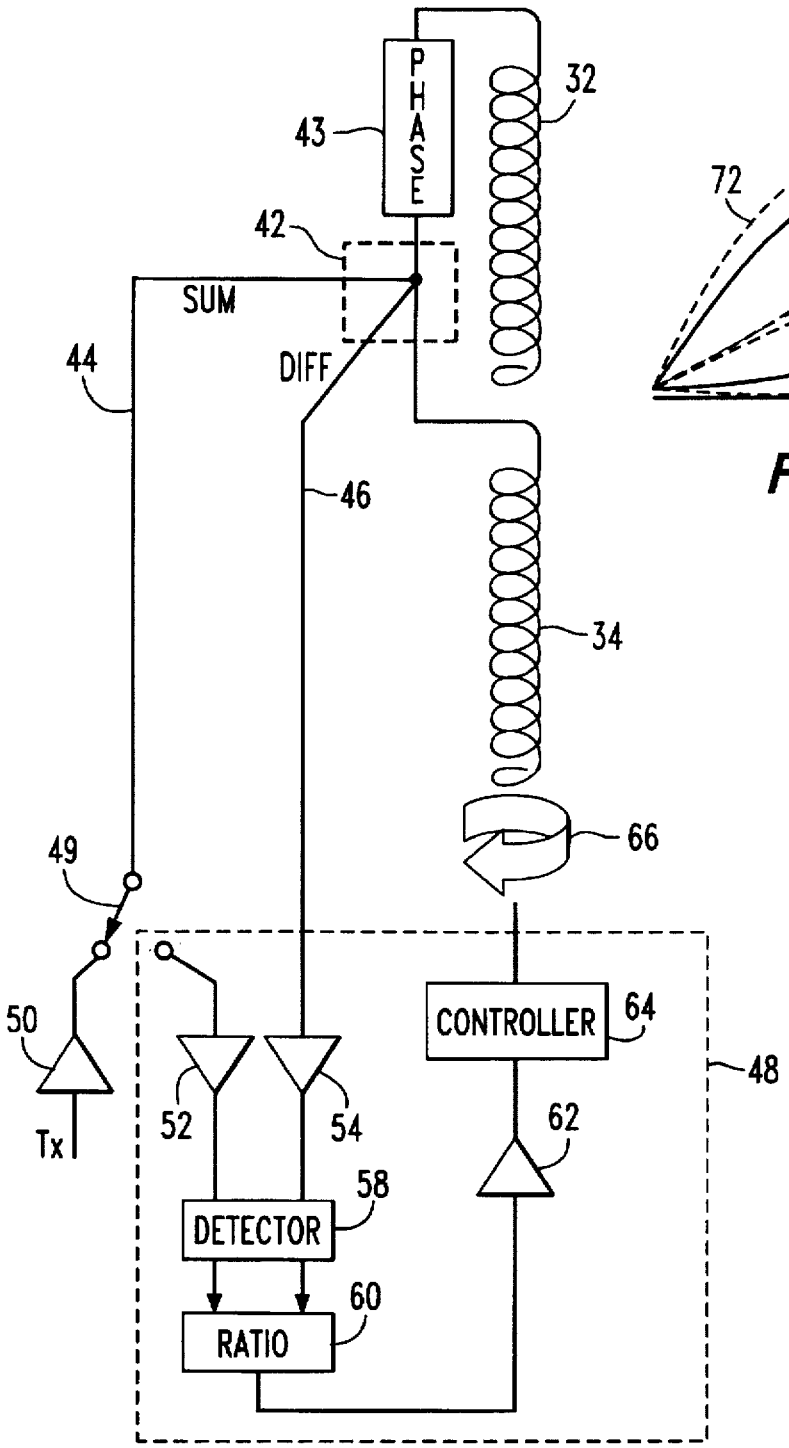
FIG. 3A illustrates the closed loop control of the present invention.

If the simple tee coupler 38 shown in FIG. 2A is replaced with a four port coupler 42 as indicated in FIG. 3A, both a transmitter and a closed loop control for the steering angle may be realized. Again, only a single conductor divided only into two segments has been shown for simplicity. During transmission mode, the four port coupler delivers a signal to be radiated along a summation line 44 to the segments 32, 34. This radiated signal will appear like that in FIG. 2B.

Figure 3B:
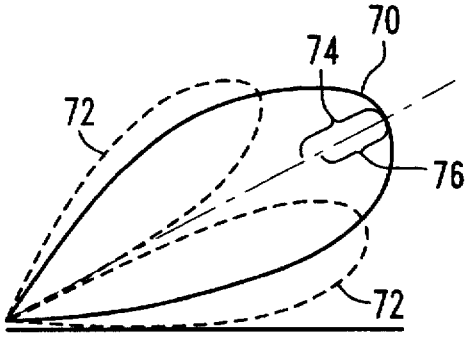
FIG. 3B illustrates the radiation patterns for both the sum and the difference signals from the antenna shown in FIG. 3A.

During the reception mode, the four port coupler 42 receives a signal from the first helical segment 32, receives a signal from the second helical segment 34, outputs a summation (sum) signal, indicated at 70 in FIG. 3B, resulting from adding the signals output by the segments 32, 34 to the summation line 44, and outputs a difference (diff) signal, indicated at 72 in FIG. 3B, resulting form the difference between the signals output by the segments 32, 34 to a difference line 46. The four port coupler 42 thus serves as a sum and diff power divider. A phase shifter 43 in one of the segments 32, 34 provides a phase difference between the signals of the segments.

A switch 49 allows selection of the transmission mode and the reception mode. When switch 49 is connected to the transmitter 50, in the position shown in FIG. 3A, the signal to be radiated is delivered from the transmitter 50 to the segments 32, 34 through the summation line 44. When the switch 49 is connected to the closed loop 48, the sum signal is transferred along the summation line 44 to the closed loop 48 and the diff signal is transferred along the difference line 46 to the closed loop 48.

The closed loop 48 includes a summation amplifier 52, a difference amplifier 54, a detector 58, a ratio unit 60, a ratio amplifier 62 and a twist controller 64. The summation signal delivered to the closed loop 48 along the summation line 44 is amplified by the summation amplifier 52. The difference signal delivered to the closed loop by the difference line 46 is amplified by the difference amplifier 54. The amplified sum and diff signals are then detected by the detector 58 in order to strip the modulation off of the carrier. Any of numerous known detectors may be used.

The ratio unit 60 receives the detected signals and outputs the magnitude and phase of the ratio of the sum and diff signals to the ratio amplifier 62. The amplified ratio is fed to the twist mechanism controller 64.

From the magnitude and the phase of the ratio of the sum and diff signals, the twisting mechanism controller 64 matches the predetermined phase difference from the ratio unit 60 in a known look-up table to determine whether any twisting correction needed. The look-up table contains values of the ratio related to the separations 74, 76 between the sum signal curve 70 and the lobes of the diff signal curve 72 shown in FIG. 3B. If the values are positive, then the antenna needs to be steered in one direction by the magnitude indicted. If the values are negative, then the antenna needs to be steered in an opposite direction by the magnitude indicted. When properly aligned, there will be no difference signal.

The twist controller 64 then outputs the direction and magnitude of the required steering to the twisting mechanism 66. This twisting mechanism is thus controlled to mechanically, automatically adjust the overall twist of the antenna 30 in a conventional manner. Advantageously, the segments 32, 34 are twisted by the same amount. Therefore, this closed loop may be used to detect errors in steering so that a closed loop correction can be achieved and the twist controlled electro-mechanically. When connected with the four port coupler, shown in FIG. 3A, and using the closed loop, the steering angle may be maintained for all frequencies with less than a decibel of error at the peak.

When the antenna 30 is comprised of more than two segments, a single twist mechanism is still employed, but all of the segments are ganged together to get a single sum and diff signal, since there is still only a single radiation pattern for the whole antenna. For multiple segments, n-1 couplers will be needed, where n is the number of segments, but there is still only one sum and one diff curve.

The above closed loop control is particularly advantageous for satellite communications. The closed loop may be used to scan for the appropriate steering angle, while the non-squinting segmented antenna will ensure that the signals at one frequency transmitted to a position established by signals received at another frequency will still be directed to the correct location.

The invention being thus described, it will be obvious that the same may be varied in many ways. Such variations are not to be regarded as a departure from the spirit and scope of the invention, and such modifications as would be obvious to one skilled in the art are intended to be included within the scope of the following claims.

What is claimed is:

1. A helical antenna comprising:

a central mast;

a conductive helix disposed about said mast;

said conductive helix being divided into a plurality of segments;

a coupler, said coupler being connected to two segments of said plurality of segments;

wherein said coupler is a four port coupler and said coupler receives a first signal from a first one of said plurality of segments and a second signal from a second one of said plurality of segments, and outputs a summation signal of said segments separated by said four port coupler and a difference signal between said segments separated by said four port coupler;

a twisting mechanism which alters the spacing and number of turns in each of said plurality of segments, thereby adjusting a steering angle of the helical antenna; and a closed loop which receives said summation signal and said difference signal output from said four port coupler and outputs a control signal to said twisting mechanism.

2. The helical antenna as claimed in claim 1, further comprising a phase shifter in one of said plurality of segments.

3. The helical antenna as claimed in claim 2, wherein said closed loop comprises a detector which detects said summation signal and said difference signal, a ratio unit which calculates a ratio of said summation signal and said difference signal, and a twist control unit which determines an amount of twisting required by said twisting mechanism in accordance with said ratio.

4. The helical antenna as claimed in claim 3, wherein said twist control unit includes a look-up table.

5. The helical antenna as claimed in claim 2, further comprising a switch which selectively alternates between delivering a signal to be transmitted to said segments and delivering said summation and difference signals to said closed loop.

6. A helical antenna as claimed in claim 1, further comprising:

a central feed tube positioned along an axis of said central mast, said central feed tube being connected to a first one of said two segments and coupled to a second one of said two segments through said coupler.

7. A method of reducing squint in a helical antenna comprising the steps of:

providing a conductive helix disposed about a central mast;

providing said conductive helix with means for accepting a signal to be transmitted and for delivering a signal received;

dividing said conductive helix into a plurality of segments;

separating two adjacent ones of said segments with a coupler, said coupler being positioned between said two adjacent ones of said segments;

outputting a first signal received by a first one of said segments to said coupler;

outputting a second signal received by a second one of said segments to said second coupler;

outputting a summation signal and a difference signal of said first and second signals from said coupler;

switching between delivering said signal to be transmitted to said segments during a transmission mode and delivering said summation and said difference signals to a closed loop during a reception mode; and altering a number of turns in said plurality of segments in accordance with an output of said closed loop.

8. The method as claimed in claim 7, wherein said closed loop comprises:

detecting said summation signal and said difference signal;

taking the ratio of said summation signal and said difference signal; and determining said output of said closed loop in accordance with said ratio.

9. The method as claimed in claim 7, wherein said altering comprises twisting each of said plurality of segments by an equivalent amount.

10. The method as claimed in claim 7, further comprising shifting a phase in one segment of adjacent segments of said plurality of segments.

* * * * *